United States Patent [19]

Wise et al.

[11] 4,057,991

[45] Nov. 15, 1977

[54] APPARATUS FOR OFFSETTING WEAR IN CHAIN SAW BAR GUIDE RAILS

[76] Inventors: Edward Wise; Mary G. Wise, both of 2220 Kenmar Road, Fortuna, Calif. 95540

[21] Appl. No.: 633,267

[22] Filed: Nov. 19, 1975

[51] Int. Cl.[2] ..... B21D 3/02

[52] U.S. Cl. ..... 72/211

[58] Field of Search ..... 72/111, 210, 211, 214

[56] References Cited

U.S. PATENT DOCUMENTS 2,450,211 9/1948 Stone et al. ..... 72/210

*Primary Examiner*—E. M. Combs

[57] ABSTRACT

Apparatus is disclosed for offsetting the lateral channel wear in chain saw bar guide rails comprising adjustable rollers mounted on a base for moving the guide rails together.

3 Claims, 5 Drawing Figures

APPARATUS FOR OFFSETTING WEAR IN CHAIN SAW BAR GUIDE RAILS

SUMMARY OF THE INVENTION

The present invention relates to apparatus for offsetting lateral channel wear in chain saw bar guide rails and comprises adjustable rollers for rollingly engaging and moving chain saw bar guide rails together, the rollers being secured to a base. The rollers are adjusted by a member operably engaging at least one of the rollers to adjust the bite of such rollers. Members are also provided for adjusting the depth of the bite of the rollers and for guiding the rollers along the periphery of a chain saw bar. In one embodiment the axes of rotation of the rollers are arranged to be in substantially the same plane, such axes being either parallel to one another or angled with respect to one another to pinch together the top wall of the guide rails to a greater degree than the bottom wall of the guide rails means are thereby provided for offsetting lateral channel wear of the chain saw bar guide rails that is more pronounced at the inner top wall of the guide rails than at the inner bottom wall of the guide rails.

DETAILED DESCRIPTION

Figure 1:
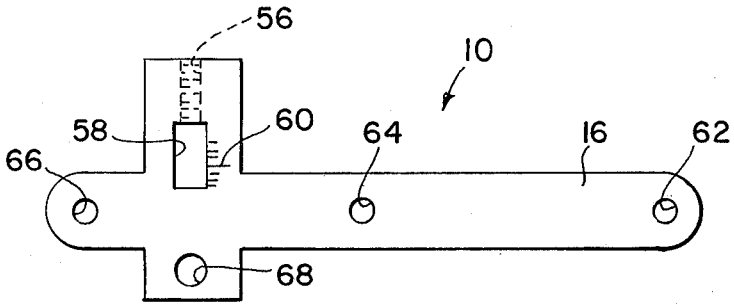
FIG. 1 is a plan view illustrating a base plate on which the roller members, guide members adjusting members and handles are mounted for apparatus used in offsetting lateral channel wear in chain saw bar guide rails according to one embodiment of the present invention.

Professional loggers who fell and buck timber for a livelihood wear out chin saw bars faster than the average home owner who uses a chain saw for clearing light timer, brush and occasionally a tree. The chain saw bar has guide rails extending the full length of the edge of the bar, the rails in turn forming a channel in between them that receives guide members extending downward into the channel from a drive chain that extends around the periphery of the bar. The saw teeth are attached to and extend in an upwardly direction away from the channel. Although a lubricant is provided so that the guide members move smoothly and with a minimum amount of friction and wear in the channel, nonetheless a certain amount of lateral wear occurs in the channel due to the cutting forces applied to the chain and guide members during use. The wear at the top inner wall of the guide rail is generally more pronounced than the wear at the bottom inner wall to the guide rails thereby producing a channel which in a front elevation or view is some what "V" shaped. This wear causes the saw to veer off a normal downward cutting path and causes the saw to bind in the cut. The prior art machines available to realign the worn walls of the guide rails comprises a hammer-like device that moves the rails together by a hammering or impacting force which has the undesired effect of distorting or pushing the metal of the outer walls of the rails upwards toward the edge thereby necessitating removal of the metal by grinding or filing which results in heavy metal losses creating thin rails that last only a short time after the bar has been reconditioned.

One of the difficulties of the aforesaid prior art machine is that is extremely bulky and can only be operated in a machine shop far removed from the logging site in most cases. A machine of this type prevents on site reconditioning of a chain saw bar and makes it necessary for a logger to carry an extra bar to the logging site if he is not to lose valuable logging time which is an increasingly important consideration in areas where the cutting season is short.

Apparatus is known in the prior art for rolling metal sheets or bars; however, none of the foregoing references teach apparatus for the alignment of chain saw bar guide rails. The references in this regard are U.S. Pat. Nos. 166,715 Nugent; 227,061 McDonald; 379,386 Forsyth; 491,668 Steel and 582,863 Jones.

It is therefor an object of the present invention to overcome these and other difficulties encountered in the prior art.

It is a further object of the present invention to provide light weight, portable apparatus for offsetting lateral channel wear in chain saw bar guide rails that does not result in heavy metal losses in the area of the guide rails.

It is a further object of the present invention to provide apparatus for offsetting lateral channel wear in chain saw bar guide rails by rolling such rails together only enough to offset wear that has occurred to thereby eliminate any metal loss in the rails.

These and other objects have been achieved by the present invention and will become apparent from the disclosure and claims that follow as well as the appended drawing.

Figure 2:
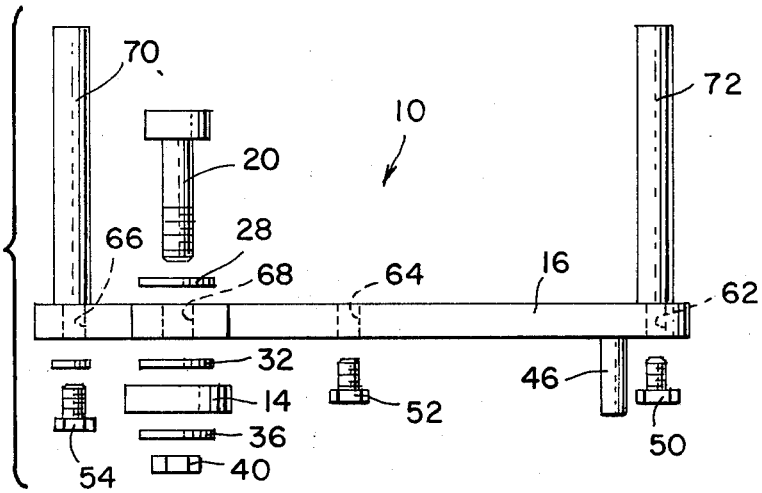
FIG. 2 is a partially exploded side elevation illustrating the base plate, roller members, guide members, and handles that are assembled to form apparatus used in offsetting lateral channel wear in chain saw bar guide rails according to one embodiment of the present invention.
Figure 3:
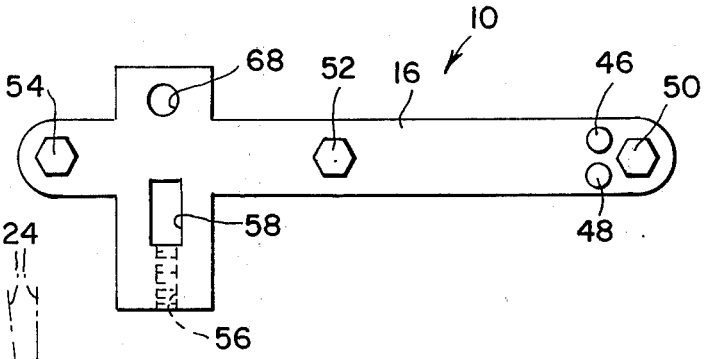
FIG. 3 is a bottom view of the base plate illustrated in FIG. 1.
Figure 4:
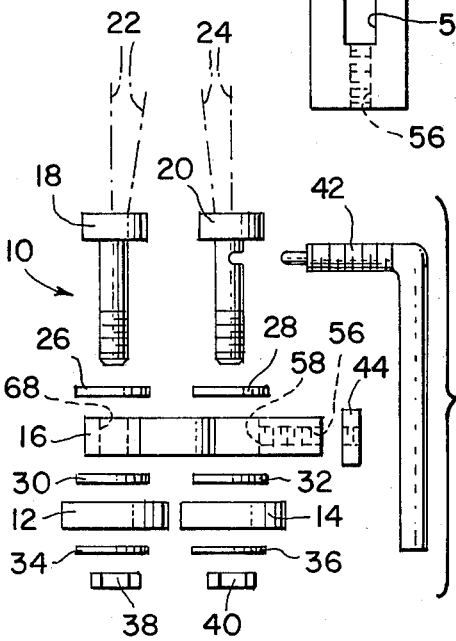
FIG. 4 is an exploded front elevation illustrating the base plate, roller members, guide members and handles that are assembled to form apparatus used in offsetting lateral channel wear in chain saw bar guide rails according to one embodiment of the present invention.
Figure 5:
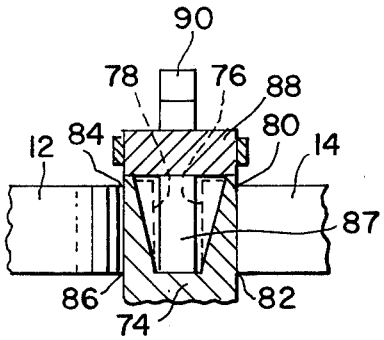
FIG. 5 is a front elevation in section illustrating the apparatus of one embodiment of the present invention in use for rolling back the rails of a chain saw bar.

Referring to the drawing and FIGS. 1 through 5, apparatus 10 is illustrated for offsetting lateral channel wear in chain saw guide bar rails comprising rollers 12 and 14 which are securable to base plate 16 by means of bolts 18 and 20 which may be mounted through plate 16 on any one of the axes between the axes 22 or the axes 24 to adjust the angle of the bite of rollers 12 and 14 so that such rollers may be aligned whereby the faces thereof are parallel at the bite or the upper edges of the faces are canted inwardly toward one another so that the bite is greater at the top of the faces than at the bottom of the faces, the hole 68 in plate 16 being drilled at the angle desired for offsetting bolt 18 if its alignment is other than horizontal, bolt 20 having a substantially horizontal groove therein to ride in slot 58 so that bolt 20 can also be offset at any predetermined angle within axes 24 in addition to a vertical angle. Bolts 18 and 20 are mounted through plate 16 and held in place by an arrangement of washers 26, 28, 30, 32, 34, 36 and lock nuts 38 and 40. An adjustment crank 42 screwingly engages a threaded hole 56 in base 16 for engaging bolt 20 and for moving bolt 20 and the roller 14 attached thereto towards or away from the roller 12 so that the bite of the rollers is adjustable. A return spring (not illustrated) is provided in channel 58 in which bolt 20 is mounted, channel 58 having highly polished and optionally plated surfaces to assure that bolt 20 rides smoothly therein, the spring being mounted in channel 58 opposite the threaded hole 56 and in an abutting relation with the shank of bolt 20. Crank 42 is locked in place by lock nut 44, once the bite of the rollers 12 and 14 is set. A scale 60 is provided along the outer edge of channel 58 to indicate the degree of bite of rollers 12 and 14. A series of roller depth adjustment bolts 50, 52 and 54 mounted in threaded holes 62, 64 and 66 respectively in plate 16 are provided for adjusting the depth of bite of the rollers 12 and 14 with respect to chain saw bar guide rails, handles 70 and 72 being provided for manually operating the apparatus 10 of the present invention by pulling or pushing it along the outer edge of a chain saw bar. Guide studs 46 and 48 extend downward from and are attached to plate 16 in the direction of rollers 12 and 14 and are spaced apart sufficiently to engage the outerwalls of a chain saw bar.

In use (referring to FIG. 5) the apparatus 10 is placed on a chain saw bar 74 so that the rollers 12 and 14 engage the upper and lower outerwalls 80, 84 and 82, 86 respectively of guide rails, lateral channel wear of the guide rails being illustrated by phantom configurations 76 and 78, the lateral channel formed by the guide rails having been worn into a "V" like configuration by guide member 87 extending from the bottom of chain 88, saw tooth 90 extending upwardly from chain 88. The apparatus 10 is moved along the upper and lower outer-walls of the chain saw bar guide rails to gently roll the rails back to offset the wear 76 and 78 in the bar so that the inner guide rails are substantially parallel to the outer-walls of the guide member 87 of the chain 88. This realignment is necessary to keep the chain saw from veering to the left or right on downward cuts which causes the saw to bind in the cut, this veering generally following an arcuate path sufficient to bind the bar in the cut since the bar is substantially flat. When the rollers are offset to provide a greater bite at the top edges thereof then at the bottom edges, the upper outwalls 80 and 84 of the guide rails will be offset to a greater degree than the bottom outer-walls 82 and 86 and permits the realignment of the guide rails with fewer passes of the apparatus 10 along the outer periphery of the bar.

Although the invention has been described by reference to some embodiments, it is not intended that the novel apparatus be limited thereby, but that modifications thereof are intended to be included as falling within the broad scope and spirit of the foregoing disclosure, the following claims and the appended drawing.

What is claimed is:

1. Apparatus for offsetting lateral channel wear in chain saw bar guide rails comprising lightweight hand held apparatus for manually aligning the guide rails of a chain saw bar, said apparatus having opposed adjustable roller means for rollingly engaging and moving chain saw bar guide rails together, said roller means secured to base means, said roller means comprising at least one first roller means adjustably secured to said base, at least one second roller means opposed to said first roller means and arranged to form a bite space between said second and first roller means, the axes of rotation of each of said opposed first and second roller means lying in substantially the same plane, said first and second roller means being arranged on said base, means operably engaging said roller means for adjusting said bite of said roller means and comprising screw means threadably engaging threaded hole means in said base for laterally displacing at least one of said roller means in said plane, said threaded hole means terminating in channel means for axially mounting one of said roller means, threaded stud means adjustably extendable from said base towards the outer face of said adjustable roller means for adjusting the depth of bite of said roller means, means for guiding said apparatus along the periphery of a chain saw bar comprising stud means extending from said base in the direction of said rollers for holding said base in alignment with the outer walls of chain saw bar guide rails, said stud means being spaced a distance substantially the same as the thickness of a chain saw bar, means for moving said roller means along the outer walls of the parallel rail of chain saw bar guide rails comprising hand held means for pulling and pushing said apparatus along the periphery of a chain saw bar.

2. The apparatus of claim 1 for offsetting the lateral channel wear in chain saw bar guide rails where the axes of rotation of said roller means are substantially parallel to one another and the faces thereof arranged to transversely and rollingly engage chain saw guide rails.

3. The apparatus of claim 1 for offsetting the lateral channel wear in chain saw bar guide rails where the axes of rotation of said roller means are at an angle with respect to one another to rollingly engage chain saw guide rails in a manner to pinch together the top wall of said guide rails to a greater degree than the bottom wall of said guide rails for offsetting lateral channel wear in chain saw bar guide rails that is more pronounced at the inner top wall of said guide rails than at the inner bottom wall of said guide rails.

* * * * *